US005092054A

United States Patent [19]

Cipiti

[11] Patent Number: 5,092,054

[45] Date of Patent: Mar. 3, 1992

[54] ARCUATE MEASURING DEVICE, AND METHODS OF CONSTRUCTING AND UTILIZING SAME

[76] Inventor: Nick J. Cipiti, 42669 Jeanette Cir., Mount Clemens, Mich. 48044

[21] Appl. No.: 553,854

[22] Filed: Jul. 16, 1990

[51] Int. Cl.[5] ..... B43L 13/20

[52] U.S. Cl. ..... 33/485; 33/509; 33/510

[58] Field of Search ..... 33/509, 510, 484, 483, 33/485, 812, 555.4, 561.1, 561.2, 561.3

[56] References Cited

U.S. PATENT DOCUMENTS

| | | | |
|---|---|---|---|
| 27,464 | 3/1860 | Moser | 33/483 |
| 139,601 | 6/1873 | Nagle | 33/485 |
| 1,168,362 | 1/1916 | Wood | 33/485 |
| 1,255,251 | 2/1918 | Waters | 33/483 |
| 2,088,290 | 7/1937 | Collier | 33/510 |
| 2,660,796 | 12/1953 | Lies | 33/812 |
| 2,972,810 | 2/1961 | Davis | 33/485 |
| 3,276,134 | 10/1966 | Szwajkowski | 33/509 |
| 3,429,049 | 2/1969 | Snoddy | 33/510 |
| 3,798,780 | 3/1974 | Forle et al. | 33/509 |
| 4,257,165 | 3/1981 | Ellison | 33/509 |

FOREIGN PATENT DOCUMENTS

| | | | |
|---|---|---|---|
| 0073930 | 12/1916 | Switzerland | 33/812 |
| 510634 | 8/1939 | United Kingdom | 33/484 |

*Primary Examiner*—Thomas B. Will

*Attorney, Agent, or Firm*—Irving M. Weiner; Robert M. Petrik; Joseph P. Carrier

[57] ABSTRACT

An arcuate measuring device for measuring distances along a spherical body such as a bowling ball. The device includes a curved guide member including measurement marking thereon. A measurement device is slidably retained on the guide member. Removable pins are provided to permit measuring between two finger holes in a bowling ball. An aperture is provided in the measurement device to permit marking a distance on the ball.

6 Claims, 1 Drawing Sheet

ARCUATE MEASURING DEVICE, AND METHODS OF CONSTRUCTING AND UTILIZING SAME

BACKGROUND OF THE INVENTION

1. Field of the Invention

The invention relates to the measurement of a distance between specific locations and surface distances on a spherical object, in particular, a bowling ball. The present invention is designed such that an accurate measurement of a curved surface can be made without the inconsistencies of straight rule measurement of spheres. The results of the application of the present invention will be a more comfortable fit for the bowler since a new ball can have the exact finger spacing as the bowler's old ball.

2. Description of the Relevant Art

Heretofore, there have been various means for measuring distances along arcuate surfaces.

The primary method of measuring arcuate surfaces comprises utilizing a flexible measuring device, such as a tape measure. This means of measuring such a surface has many shortcomings when attempting to locate an exact position on a ball for a finger hole or plug.

It is extremely difficult to employ a stiff measuring device, generally known as a ruler, for measurements along arcuate surfaces.

The present invention provides a curved member with arcuate measurements thereon, and a means for adjustably measuring the location for finger holes and plugs.

SUMMARY OF THE INVENTION

It is, therefore, an object of the present invention to provide for the accurate measurement of distances along the outer surface of spherical bodies.

More specifically, it is an object of the present invention to pinpoint where new holes should be bored, and of what size (diameter), in order to provide the individual bowler with a sense of comfort when using his new ball.

It is a further object of the present invention to provide an easier method by which individual bowlers or pro shop operators can locate the region on a new ball where the holes should be drilled so as to match with those on the individual's old ball, thus resulting in more satisfied customers.

The above and further objects, details and advantages of the present invention will be apparent from the following detailed description, when read in conjunction with the accompanying drawings.

DESCRIPTION OF THE PREFERRED EMBODIMENT

Figure 1:
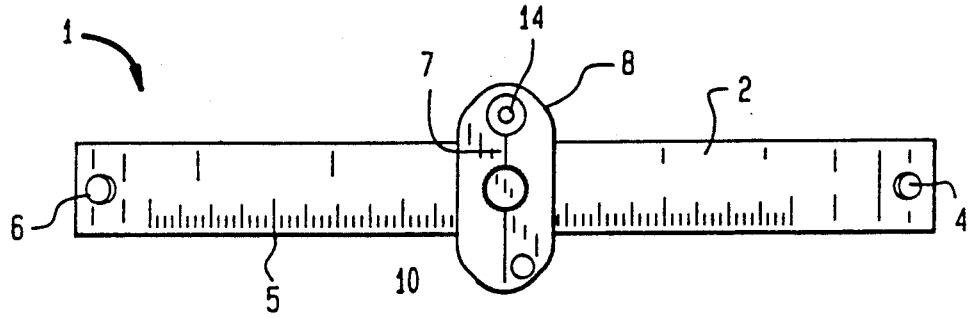
FIG. 1 illustrates a top view of the measuring device showing the sliding plastic gauge as well as the two stoppage points at the ends of the device, in accordance with the present invention.
Figure 2:
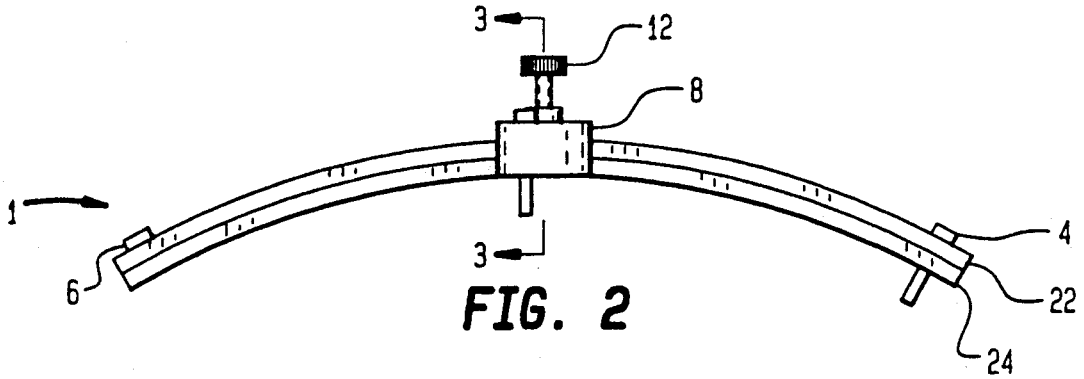
FIG. 2 illustrates a lateral view of the device in accordance with the present invention.

Referring to the drawings wherein like reference numerals designate the same parts in several views, there is illustrated one embodiment of the present invention.

The gauge device 1 includes a guide 2 made of plastic, metal, or other hard material that is curved in such a way as to meet with the general curve of a bowling ball. Guide 2 is sufficiently flexible to permit the measurement of other arcuate shaped members of various sizes. It will include markings 5 in inches or other well known measure along the outer edge.

At each end of the guide 2 are stoppage points. A first stop means may be in the form of a removable slender elongate member or pin 4. Pin 4 may be made integral with the guide. The second stop means is in the form of a node 6. These stop means 4,6 may be made of plastic, metal, or the material that makes up the guide 2, itself.

The stop means 4,6 are provided to prevent the sliding measuring member 8 from being separated from the guide 2. Member 8 is transparent to permit viewing of the markings 5. The member 8 has thereon a secondary removable pin 10 which may be used to position the member 8 at the proper position along the surface of the bowling ball, for example, to be inserted in a finger hole with pin 4 inserted in a first hole. Member 8 includes a line 7 which is alignable with markings 5 for exact measurement of a span.

Also provided on the member 8 is a screw 12 that comprises a means for exerting downward force on the guide member 8. The screw 12 passes through the top of the member 8 and, when tightened, fits snugly to the guide 2 securing the member 8 from lateral movement. The aperture for the screw 12 is threaded.

Additionally, on the member 8 is an aperture 14 through which the ball or other arcuate member can be marked. Aperture 14 permits a pencil or other marking means to contact the member being measured when the secondary pin 10 has been removed.

Aperture 14 for marking the ball will preferably be cone shaped and provided on the side opposite pin 10 on the member 8. Preferably, stop means 4 and pin 10 are removably held by the gauge device 1 to permit the guide to be laid directly upon the arcuate means being measured.

The pin 10 may be made of the same material as the stop means 4, 6 provided at the ends of the guide 2. The screw 12 used to hold the member 8 steady will consist of a metal shaft with the head made of plastic, metal, or other hard material. The head of the screw will be ridged along the outside so as to provide for an easier grip.

Figure 3:
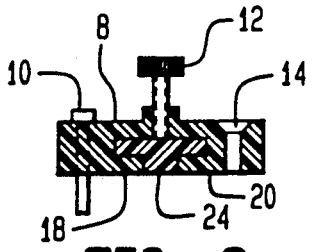
FIG. 3 illustrates a cross sectional view along line 3—3 of FIG. 2 in accordance with the present invention.

As best seen in FIG. 3, the cross-section of guide 2 is T-shaped with a corresponding centrally located aperture in the member 8. The aperture in member 8 include arms 18, 20 on each side to ensure secure clamping of member 8 to the guide 2 by screw 12. Guide 2 includes upper portion 22 and lower portion 24. Upper portion 22 includes markings 5 which are viewable through member 8. The arms 18,20 are coextensive with the bottom of lower portion 24.

In use with regard to a bowling ball, if a specific distance is required from a first finger aperture, stop means 4 is inserted in the first aperture with the sliding member 8 aligned to the proper distance. A pencil or other marking means may then be inserted in aperture 14 to indicate the next location for a finger hole. Of course, the same process could be followed for marking distances on other arcuate members. In addition, if the present distance between two holes is unknown, each pin may be inserted in a hole, with screw 12 loosened to permit sliding, screw 12 is then tightened and the measurement read.

Although there has been described what is at present considered to be preferred embodiments of the invention, it will be understood that various modifications and variations may be made therein, and it is intended to cover in the appended claims all such modifications as fall within the true spirit and scope of the invention.

I claim:

1. An arcuate distance measuring apparatus comprising:

a generally T-shaped curved guide member, having an upper wide portion and a lower portion, including markings indicating a distance measurement;

a transparent measuring means including a channel on a lower surface to accommodate at least said upper portion of said guide member;

means for securing said measuring means along said guide member including gripping arms at the lower side of said channel and a means for exerting downward force on said guide member to force said upper portion against said gripping arms, said gripping arms having a bottom side which is coextensive with the bottom of said guide member lower portion;

said means for exerting downward force being located substantially central on said measuring means;

said measuring means includes at least one aperture beyond the perimeter of said guide member, said at least one aperture includes a first and second aperture, said first aperture resembling a cone in cross-section and adapted to accommodate a writing utensil, said second aperture adapted to receive a removable slender elongate member; and means for preventing removal of the measuring means from said guide member.

2. The apparatus of claim 1, wherein:

said means for preventing removal of the measuring means comprises at least one node at one end of said guide member.

3. The apparatus of claim 1, wherein:

said means for preventing removal of the measuring means comprises at least one removable slender elongate member passing through a corresponding aperture at one end of said guide member.

4. The apparatus claims 1, wherein:

said transparent member includes a measurement line across its width corresponding to the center of said first aperture.

5. The apparatus of claim 4, wherein:

said means for preventing removal of the measuring means comprises a node on an upper side at a first end of said guide member, a third aperture at a second end of said guide member, and a removable elongate slender member passing through said third aperture.

6. The apparatus of claim 5, wherein:

said means for exerting downward force comprises a threaded member inserted into a threaded aperture on said measuring means.

* * * * *